United States Patent [19]

Traylor

[11] Patent Number: 4,771,485

[45] Date of Patent: Sep. 20, 1988

[54] FAUCET FIXTURE

[76] Inventor: Paul L. Traylor, 16591 Milliken Ave., Irvine, Calif. 92714

[21] Appl. No.: 866,402

[22] Filed: May 23, 1986

[51] Int. Cl.[4] ..... E03C 1/00

[52] U.S. Cl. ..... 4/191; 137/216; 137/616.3; 137/359; 137/801; 137/454.2; 137/552.7; 210/85; 239/588

[58] Field of Search ..... 4/191, 192, 195; 210/85; 137/216, 216.1, 616.3, 359, 801, 454.2, 554, 552.7; 239/588, 281, 30; 206/534, 459

[56] References Cited

U.S. PATENT DOCUMENTS

| | | | |
|---|---|---|---|
| 1,135,917 | 4/1915 | Partington | 239/30 |
| 2,200,503 | 5/1940 | Judell et al. | 239/588 |
| 2,344,150 | 3/1944 | Judell | 239/588 |
| 2,790,632 | 4/1957 | Mellette | 137/801 |
| 3,424,336 | 1/1969 | Perez et al. | 206/459 |
| 3,620,241 | 11/1971 | Brown | 137/216 |
| 3,669,141 | 6/1972 | Schmitt | 137/359 |
| 3,680,780 | 8/1972 | Arbon | 239/30 |
| 3,706,321 | 12/1972 | Vicari | 137/554 |
| 3,766,882 | 10/1973 | Babbitt, III | 206/534 |
| 3,967,638 | 7/1976 | Tondreau | 137/216 |
| 4,134,419 | 1/1979 | Richetti | 137/216 |
| 4,186,761 | 2/1980 | Guarnieri | 4/192 |
| 4,210,533 | 7/1980 | Astl | 137/216 |
| 4,454,891 | 6/1984 | Dreibelbis et al. | 137/216 |
| 4,457,342 | 7/1984 | Moen | 137/801 |

FOREIGN PATENT DOCUMENTS

| | | | |
|---|---|---|---|
| 512257 | 1/1955 | Italy | 137/801 |

*Primary Examiner*—Henry J. Recla
*Assistant Examiner*—Linda J. Sholl
*Attorney, Agent, or Firm*—Fulwider, Patton, Rieber, Lee & Utecht

[57] ABSTRACT

A faucet fixture for mounting over the faucet opening in sink structure and including a valve body capable of being pulled upwardly of the faucet fixture housing to an elevated position for inspection or maintenance. The faucet fixture includes an upper mounting plate having a threaded central bore for receiving a threaded sleeve for securement of the plate and sleeve to the sink structure. The valve body is removably secured to the mounting plate, and a potable water conduit attached to the valve body extends slidably through the sleeve for distance at least equal to the height of the housing which supports the valve body in position so that the valve body can be inspected. In one embodiment the sleeve also slidably accommodates inlet and outlet waste water conduits associated with a reverse osmosis unit so that an airgap arrangement attached to the valve body can be raised and inspected by sliding the three conduits upwardly through the sleeve.

12 Claims, 3 Drawing Sheets

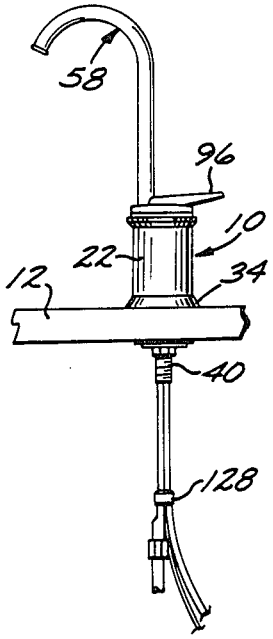
FIG. 1
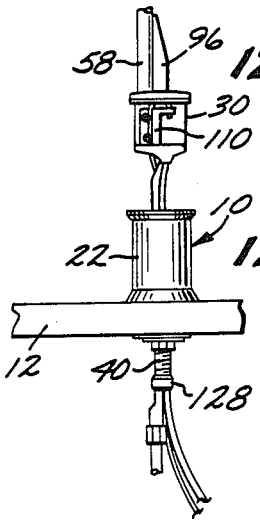
FIG. 2
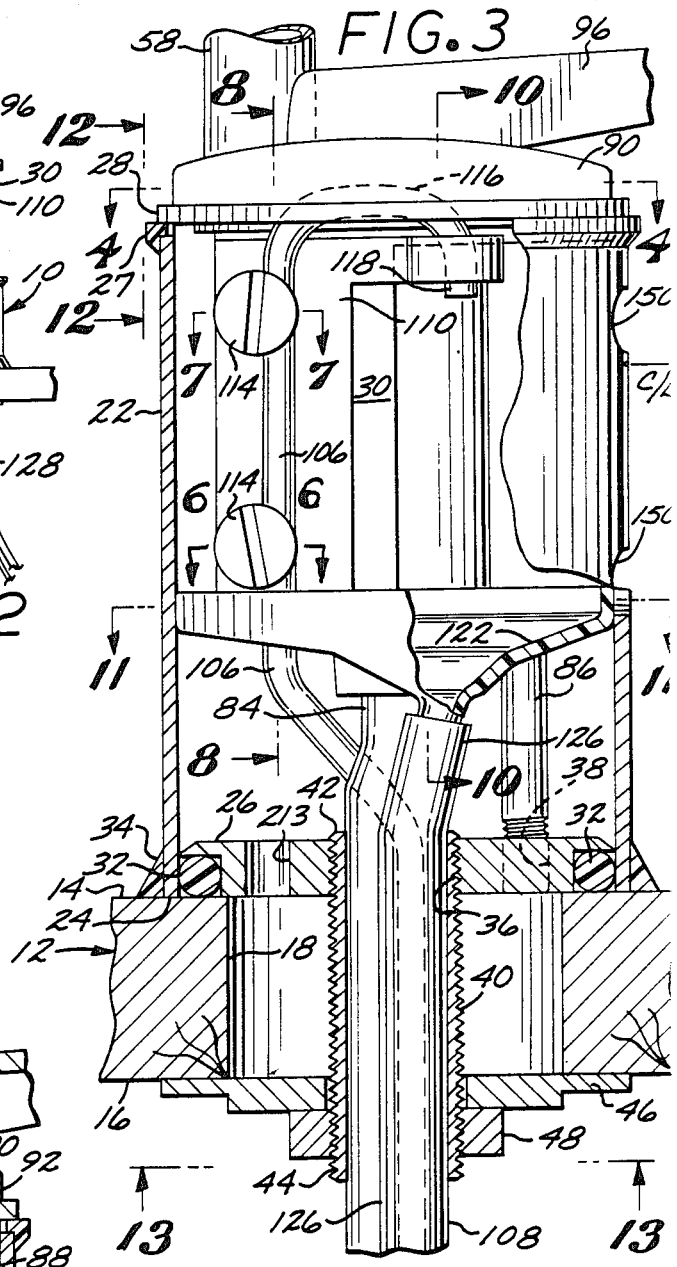
FIG. 3
FIG. 5
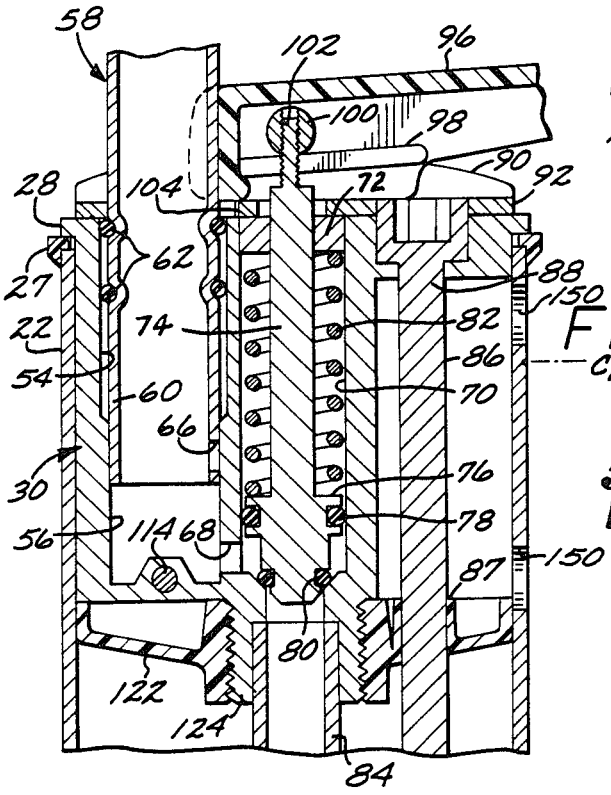
FIG. 4
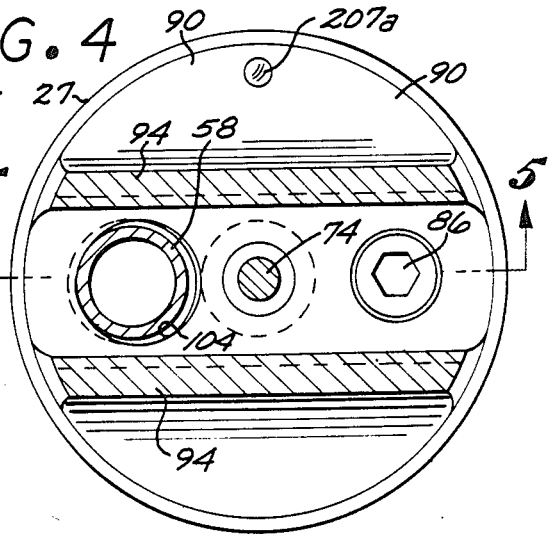

FAUCET FIXTURE

BACKGROUND OF THE INVENTION

1. Field of the Invention

The present invention relates to a faucet fixture for attachment to sink structure, and more particularly to a faucet fixture having a valve body located within and separable from a housing sleeve for inspection and maintenance of the valve body and related components without disconnection of associated water conduits.

2. Description of the Prior Art

Faucet fixtures of the type to which the present invention is directed are auxiliary faucets adapted for mounting to existing sink structure. They may be a carafe type for association with a single potable water conduit to dispense water into carafes or like containers, or they may be a reverse osmosis or "RO" type of fixture. The latter type of fixture is adapted for association with a potable water conduit connected to an RO system. Such RO systems usually require two additional conduits, namely, a discharge waste water inlet conduit and an outlet conduit for connection to the faucet fixture.

An RO system produces a continuous flow of waste water that is typically discharged into a sewer system. The waste water passes from the RO system, upwardly through the waste water inlet conduit, into the faucet fixture, through an airgap arrangement and then to the outlet conduit. The air gaps is required by most local plumbing code ordinances to be about an inch to prevent back-syphoning of sewage or tainted water into the RO system. Plumbing codes usually also require a so-called "critical level" (C/L) to be established and permanently marked on each airgap type of faucet, with the C/L or height location required to be at least one inch above the faucet mounting base.

Prior art auxiliary faucet fixtures of the carafe or RO type are not easily serviced because they must generally be completely dismantled and separated from the sink structure to do this. Prior art RO airgap type faucet fixtures present additional problems because they require that the three conduits associated with such fixtures be installed through a relatively large opening in the kitchen sink, in the order of $1\frac{1}{4}$ inches. Sometimes sinks are made with a preformed opening, but the size of the opening is not standard, sometimes being 7/16 inch, $\frac{1}{2}$ inch, or $1\frac{1}{4}$ inches. Obviously, where a faucet opening is not present or not of an adequate size, special drilling is required to make an opening of the proper size in the usual porcelain clad cast iron sink. The net result of these shortcomings of the prior art is that no one faucet fixture is universally capable of being mounted in holes measuring from 7/16 inch to $1\frac{1}{4}$ inch and above.

Prior art auxiliary fixtures also lack dispensing spouts which are vertically adjustable to suit different installations. Such fixtures also lack any provision for selectively controlling the flow volume of potable water by means of spout orientation.

The inability to easily service prior art RO airgap faucet fixtures is a particular problem because existing airgap arrangements usually include some metal defining the conduit path, rendering them susceptible to clogging by foreign matter such as mineral deposits. As indicated before, there is no easy means of maintaining such faucets without completely disassembling them for repair or replacement.

Prior art faucets requiring relatively large faucet openings include U.S. Pat. No. 3,967,638, issued to Tomdreau; U.S. Pat. No. 4,454,891, issued to Dreibelbis et al; and U.S. Pat. No. 3,620,241, issued to Brown. These and other prior art fixtures require disassembly and separation from the sink structure for maintenance. The structure of U.S. Pat. No. 4,134,419, issued to Richetti, is also of interest in this regard.

SUMMARY OF THE INVENTION

According to the present invention, a faucet fixture is provided which is easily attachable to the upper surface of a sink structure, often without any need for access to the underside of the sink structure.

The faucet fixture includes an upper mounting plate to permanently overlie the faucet opening. In one embodiment the plate has a threaded central bore which accepts a threaded mounting sleeve which can easily be disposed through faucet openings as small as from 7/16 inches. The plate can be fastened to the sink structure by various means, some of which can be disposed downwardly through larger sink openings to enable complete mounting of the faucet fixture from the top.

The faucet fixture includes a sleeve or housing removably attachable to the upper mounting plate. The housing encloses and supports a valve body which is connectable to the potable water source by a potable water conduit extending through the mounting sleeve. In preferred embodiments, the housing is separable from the valve body without disconnection of the mounting plate from the sink structure. This can be done by raising the valve body upwardly of the sleeve, permitting easy servicing of the valve body and related components.

The valve body mounts a dispensing spout which is vertically slidable within a spout bore in the valve body to adjust the spout height. The valve spout is also adjustably rotatable in the spout bore to meter the rate of flow of potable water through the spout.

In a typical RO embodiment of the faucet fixture, the valve body includes an airgap system having a gooseneck upper portion connected to or comprising the inlet waste water conduit to the valve body. The airgap system also includes a cup shape drain receiver supported by the valve body in airgap relation below the discharge end of the gooseneck portion to receive the waste water. An outlet waste water conduit connected to the receiver carries off the waste water to a suitable sewer drain. Both the waste water conduits are preferably made of plastic to reduce liming and clogging.

All conduits in one embodiment are axially slidably disposed through the mounting sleeve. More particularly, the potable water conduit as well as the waste water conduits include portions which extend below the lower end of the sleeve. These portions constitute valve extension portions which are freely slidable within the sleeve. Such portions have a minimum length which approximates the height of the housing so that the valve body can be pulled upwardly of the housing and upper mounting plate for inspection or maintenance of the valve body.

Certain embodiments of the invention include structure to adjust the waste water flow rate, to provide indicia useful to the householder in the maintenance of an RO system, and to resiliently limit the upward movement of the valve body during inspection and maintenance.

Other aspects and advantages of the present invention will become apparent from the following more detailed description taken in conjunction with the accompanying drawings.

BRIEF DESCRIPTION OF THE DRAWINGS

FIG. 1 is a side elevational view of the present faucet fixture mounted to a sink structure, the fixture being illustrated in association with a potable water conduit and a pair of waste conduits;

FIG. 2 is a view similar to FIG. 1, but illustrating the valve body pulled upwardly of the housing for inspection and maintenance;

FIG. 3 is an enlarged side elevational view, partially cut away and partially in section, illustrating the installed fixture of FIG. 1;

FIG. 4 is a view taken along the line 4—4 of FIG. 3;

FIG. 5 is a view taken along the line 5—5 of FIG. 4;

DESCRIPTION OF THE PREFERRED EMBODIMENTS

Figure 6:
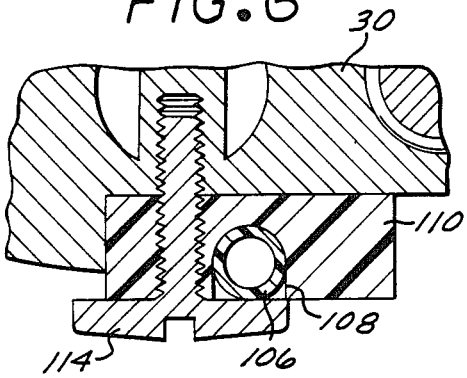
FIG. 6 is an enlarged view taken along the line 6—6 of FIG. 3.

Referring now to FIGS. 1–13, a faucet fixture 10 according to the present invention is illustrated in association with a counter or sink structure 12. As best seen in FIG. 3, the sink structure 12 includes an upper surface 14, a lower surface 16 and a faucet opening 18.

The fixture 10 is adapted for mounting in association with faucet openings of various sizes, the faucet opening 18 being typical of relatively large openings in the order of $1\frac{1}{4}$ inches which are often provided in currently marketed sinks. The fixture 10 can be mounted in a smaller opening, but the larger openings make it possible to mount the fixture 10 completely from the top of the sink structure 12. Smaller faucet openings, such as the faucet opening 20 of FIG. 15, require some undersink access.

The fixture 10 includes an open ended cylindrical housing 22 of predetermined height. The inner wall of the housing end 24 preferably has an interference fit with a peripheral flange of a circular disk or upper mounting plate 26. The plate fits over the faucet opening and once installed is not normally removed.

The upper end of housing 22 is surmounted by an upper annular gasket or bezel 27 which, as seen in FIG. 5, supports a circular flange 28 of a valve body 30. The body 30 is downwardly slidably receivable within the hollow interior of the housing 22.

As seen in FIG. 3, an O-ring 32 underlies the peripheral flange of the upper mounting plate 26 to provide a fluid seal and frictionally constrain the fixture 10 against rotation relative to the sink structure upper surface 14. A lower bezel 34 surrounds the lower end of the housing 22 for cosmetic purposes.

In the embodiment of FIG. 3 the plate 26 includes a threaded central bore 36 and a fastener bore 38, which is illustrated in dotted outline. An elongated threaded hollow member or sleeve 40 having upper and lower ends 42 and 44 is threadably disposed within the plate central bore 36.

The sleeve upper end 42 opens into the interior of the housing 22, while the lower end 44 extends below the lower surface 16 of the sink structure 12 and through a central aperture of a lower mounting plate 46. It threadably receives a mounting nut 48 to secure the upper mounting plate 26 to the sink structure 12.

Figure 13:
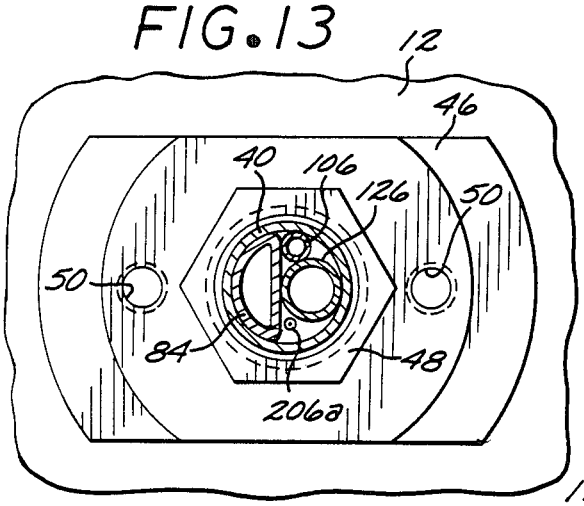
FIG. 13 is a view taken along the line 13—13 of FIG. 3.
Figure 14:
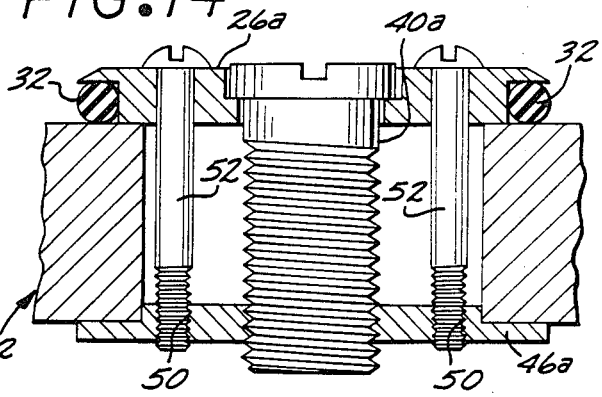
FIG. 14 is an illustration of two different means for attaching the upper mounting plate to a sink structure having a relatively large faucet opening, only one of the means being used in an actual installation.

The plates 26 and 46 are preferably made "universal", that is, suited for various methods of mounting the fixture to the sink structure. Thus, as seen in FIGS. 13 and 14, the plate 26 may include a pair of openings to slidably receive a pair of bolts 52. The plate 46 includes aligned openings which are threaded to receive the lower ends of the bolts 52.

The plate 46 is preferably made narrower than it is wide so that, where a large sink opening is available, the plate 46 can be attached to one bolt 52, cocked at an angle for downward disposition through the sink opening, and then oriented to receive the second bolt 52. This permits top mounting of the fixture without having to gain access to the sink underside.

Figure 15:
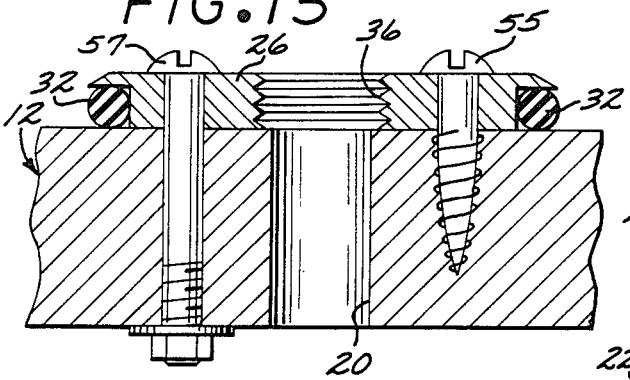
FIG. 15 is a view similar to FIG. 14, but illustrating two different fastener means for mounting the upper mounting plate in association with a smaller faucet opening, only one of the means being used in an actual installation.

FIG. 15 illustrates two other methods of fixture attachment when the sink structure is made of wood or the like. One method uses a pair of screws 55 (only one of which is illustrated) disposed through the fastener openings in the plate 26 and screwed into the sink structure. The other method uses a pair of nut and bolt assemblies 57 (only one of which is illustrated) extending through the pair of plate fastener openings and through the sink. Both methods can be used with the smaller faucet opening 20.

FIG. 14 also illustrates a modified form of threaded sleeve **40*a* cooperative with modified plates 26*a* and 46*a*. The central opening of the plate 26*a* is unthreaded and inludes a counterbore for rotatably receiving the slotted head of the sleeve 40*a*, and the central opening of the plate 46*a* is threaded to threadably receive the lower extremity of the modified sleeve 40*a*. This arrangement eliminates any need for a mounting nut 48. Although FIG. 14 includes a showing of fasteners 52, the modified sleeve 40 eliminates any need for such fasteners and adapts the fixture for mounting in both small and large size faucet openings. The fasteners 52 are simply included as an optional arrangement to illustrate the universality of connection capability of the fixture 10**.

The valve body 30 includes a vertical spout bore which receives a dispensing spout 58 having an upper gooseneck configured discharge portion and an upright lower portion 60. The portion 60 includes a pair of vertically spaced, annular grooves which seat sealing O-rings 62 which slidably engage a larger diameter upper bore portion 54 of the spout bore. The lower end of spout portion 60 is open and is slidably received within a reduced diameter spout bore portion 56. The lower end includes a transverse opening 66. When the lower end of the spout 58 rests on the bottom of the spout bore, the opening 66 is alignable with a lateral passageway 68.

The passageway 68 extends between the spout bore and an adjacent, vertically oriented valve bore 70 provided in the valve body 30. The rate of flow of potable water through passageway 68 for discharge through the spout 58 can be adjusted by slightly rotating the spout relative to the valve body 30 to alter the degree of alignment of the opening 66 with the passageway 68.

Unlike most prior art fixtures, the spout 58 is vertically adjustable to suit various sink installations, and also, as indicated, rotatable in its lowermost position to control the rate of potable water flow. In its upper position the spout may be rotated 360 degrees if desired with no affect on the volume of flow of potable water.

A valve 74 is located in the valve bore 70 to control the flow of potable water through the passageway 68. The valve 74 includes a centrally apertured disk 72 which vertically slidably receives the stem or shank 102 of the valve 74. The lower extremity of the valve includes an integral grooved flange 76 which receives a sealing O-ring 78. Another sealing O-ring 80 is carried by the lower end of the valve 74 for seating upon a seat or shoulder formed by a reduced diameter bore portion of the valve bore 70. A compression spring 82 acts against the disk 72 and flange 76 to urge the valve 74 into seated relationship upon the shoulder to stop any flow of potable water from a potable water conduit 84.

If the valve body 30 is made of a copper alloy, the conduit 84 is also preferably made of a copper alloy and is soldered within a counterbore provided in the lower end of the valve body. Of course, both of these components can be made of plastic, if desired, and connected together by any suitable means.

As best seen in FIGS. 3 and 5, the valve body 30 is firmly secured to the housing 22 by an Allen headed fastener 86 disposed through a vertical fastener hole 88 in the upper part of the valve body 30. The head of the fastener 86 is seated within a counterbore of the hole 88, while the lower end of the fastener 86 is threaded into the upper mounting plate opening or bore 38.

Figure 12:
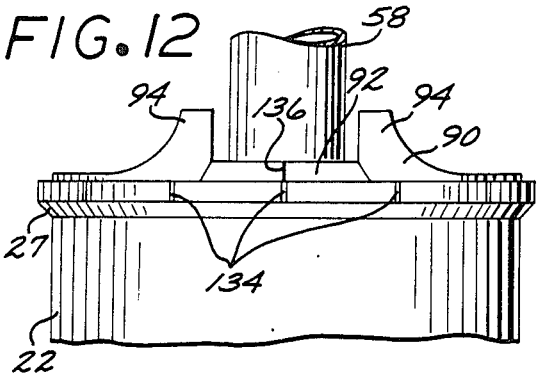
FIG. 12 is a side elevational view of the upper portion of the valve housing in association with a bezel carrying informational indicia.

As best seen in FIGS. 3, 4 and 12, the upper end of the housing 22 is closed by a circular cap or cover 90 which rests upon the valve body flange 28. The cover 90 also normally maintains the spout 58 and valve 74 in position. It includes a transverse slot which slidably receives a locking slide 92. In addition, the cover 90 includes trunnion portions 94 which pivotally support a valve handle 96 having internal rails 98, as seen in FIG. 5, which laterally slidably fit over a trunnion or pivot pin 100. The pin 100 includes a threaded vertical opening which receives the threaded upper stem 102 of the valve 74.

Depressing the valve handle 96 raises the cylinder 100 and valve 74 to admit potable water into the spout 58 for discharge. Upwardly pivoting the handle also admits water, the over-center mounting of the handle maintaining this up position, as seen in FIG. 2, until the handle is depressed to the position of FIG. 3.

The location of the valve handle 96 over the fastener 86 conceals the fastener, enhancing the appearance of the faucet and reducing the likelihood of any tampering with the fastener.

The locking slide 92 includes an opening 104 having a diameter equal to that of the upper spout bore portion 54, through which the spout passes. The slide 92 is normally in the "locked" position illustrated to prevent upward passage of the uppermost one of the O-rings 62, thereby preventing upward removal of the spout 58. Upon removing the fastener 86, the slide 92 can be moved to the left to align with bore 54. This allows the spout 58 to be removed by pulling straight up.

Figure 16:
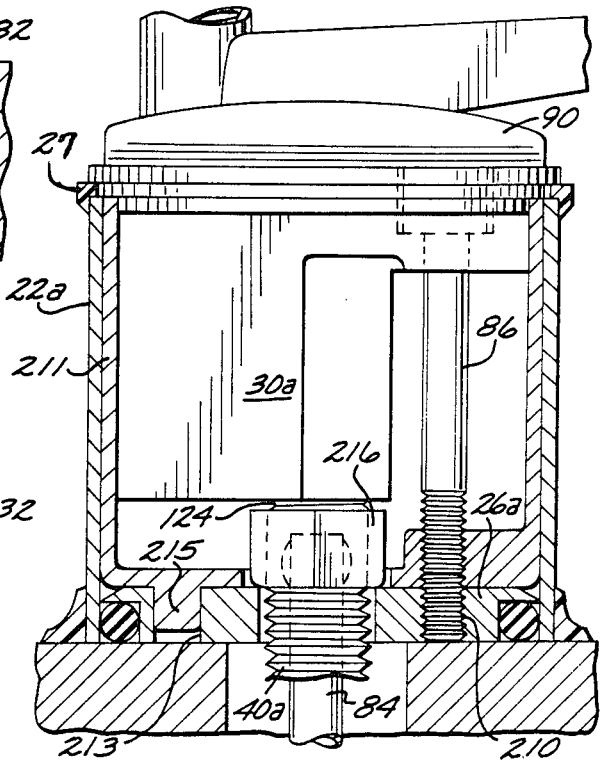
FIG. 16 is a side elevational view, primarily in cross section, illustrating a carafe type of faucet fixture.

The elements thus far described are also found in the embodiment of FIG. 16, which is a carafe version of the fixture 10. In this version a single potable water conduit 84 is disposed through the interior of the mounting sleeve 40. For servicing, the portion of the conduit 84 extending below the lower end of the sleeve 40 is made sufficiently long to define a valve extension portion which is upwardly slidable within the sleeve 40 to permit the valve body **30*a* to be inspected or repaired when necessary. In the carafe embodiment of FIG. 16, the valve body 30*a* is secured by the fastener 86 within an upwardly open casing 211 which slidably fits downwardly within a cylindrical housing 22*a*. The single potable water conduit 84 is made of plastic material and extends through a threaded sleeve 40*a* which is slidably disposed through a central opening in a modified upper mounting plate 26*a*. The sleeve 40*a* mounts a hexagonal compression fitting or nut 216 which fits within a complemental hexagonal opening in the base of the casing 211. The nut 216 threads upon a depending threaded boss 124 of the valve body to provide a fluid tight connection between the potable water conduit 84** and the valve body.

Figure 11:
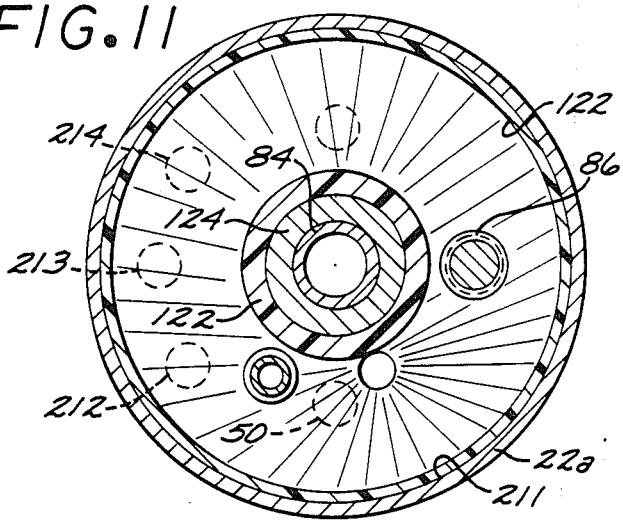
FIG. 11 is a view taken along the line 11—11 of FIG. 3.

The foregoing arrangement enables a user to pull the casing 211 and valve body **30*a* up out of the housing to facilitate filling a carafe or the like. The base of the casing includes a depending boss 215 which, as seen in FIG. 11, is receivable within one of three openings 212, 213 and 214 provided in the upper mounting plate 26*a*. When the casing is replaced within the housing, the boss 142 is placed by the user in that one of the openings 212, 213 or 214 which best orients the handle 96** for convenient actuation.

Figure 7:
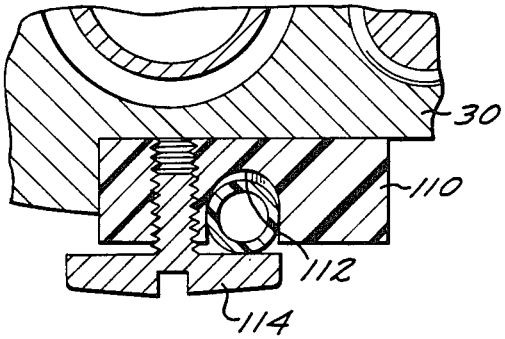
FIG. 7 is an enlarged view taken along the line 7—7 of FIG. 3, illustrating the waste conduit prior to crimping.
Figure 8:
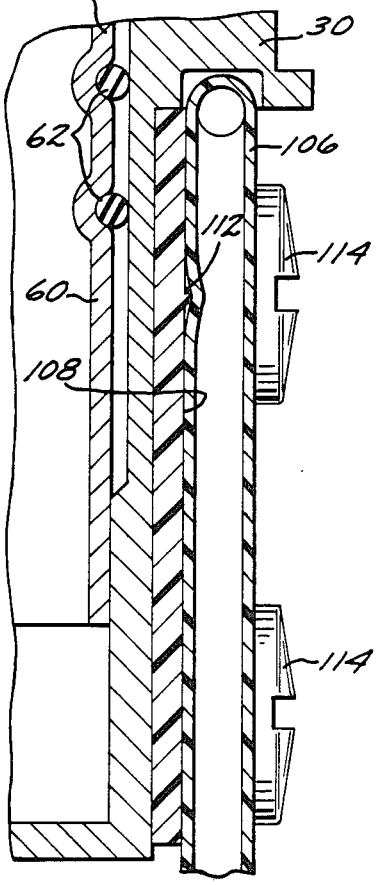
FIG. 8 is an enlarged view taken along the line 8—8 of FIG. 3, illustrating partial crimping of the waste conduit to control the flow of waste water therethrough.

A capability for upward movement of the valve body is also present in the reverse osmosis (RO) embodiment of FIG. 3 except that in the embodiment of FIG. 3 the valve body 30 is also associated with a pair of RO waste water conduits provided for connection to a typical RO system. More particularly, a waste water inlet conduit 106, which is preferably made of resiliently deformable plastic, is slidably disposed through the interior of the sleeve 40 adjacent the potable water conduit 84. As best seen in FIGS. 6–8, it is arranged within a vertical groove 108 provided in a valve body fastener 110 of inverted L-shape. The groove 108 includes a transverse ridge 112 which underlies the inlet conduit 106. A pair of suitable screws 114 are threadably disposed through openings in the fastener 110 such that the heads of the screws 114 overlie the inlet conduit 106. The upper screw 114 opposite the ridge 112 can be tightened to throttle flow through the conduit, as seen in FIG. 7. This affords a means for controlling the rate of waste water flow. The lower fastener 114 secures the fastener 110 to the valve body 30.

The uncompressed and compressed states of the inlet conduit 106 are illustrated in FIGS. 7 and 8, respectively. If desired, the groove 108 could be provided in the back side of the valve body fastener 110 (not shown) to squeeze the conduit 106 between the fastener 110 and the valve body 30.

Figure 10:
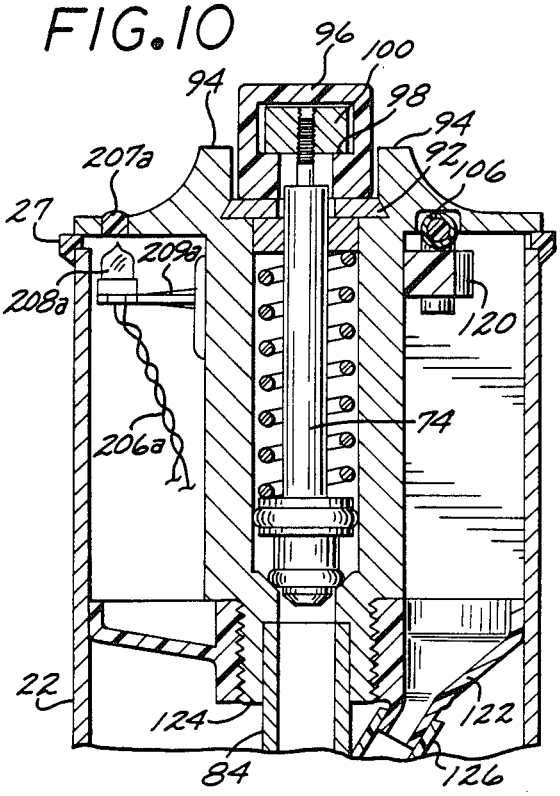
FIG. 10 is a view taken along the line 10—10 of FIG. 3.

The upper extremity of the inlet conduit 106 is reversely formed to define a loop or gooseneck 116 which terminates in a downwardly directed discharge end 118. The end 118 is disposed through a vertical opening in the leg 120 of the L-shape fastener 110, as seen in FIGS. 3 and 10. This arrangement provides a relatively quick and inexpensive means to establish the upper portion of an airgap combination. The lower part of the airgap combination is defined by an upwardly open cylindrical basin or cup which defines a waste drain 122. Air from the outside enters through a pair of openings 150 in the housing 22.

The drain 122 includes a central internally threaded bore which is threaded upon the depending, externally threaded boss 124 of the valve body 30. The upwardly open drain 122 is adapted to catch any waste water discharged through the inlet conduit end 118. The airgap or spacing is preferably one inch or more to meet most municipal plumbing code ordinaces.

The central portion of the drain 122 includes a narrowed tubular portion which receives the upper end of a waste water outlet conduit 126. The conduit 126 is preferably made of plastic slidably disposed through the mounting sleeve 40 alongside the conduits 84 and 106, as best seen in FIG. 13.

Figure 9:
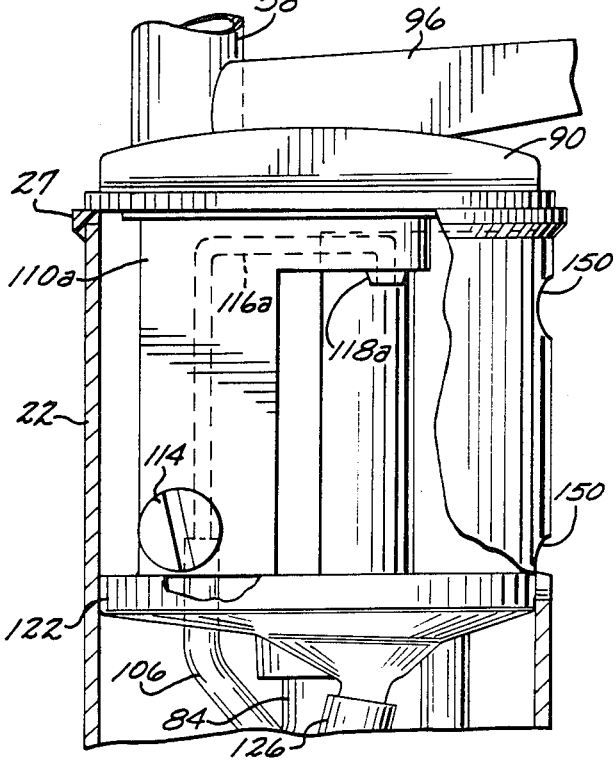
FIG. 9 illustrates an alternate means of carrying waste water, such means comprising a cored plastic member attached to the valve body.

FIG. 9 illustrates an alternative airgap combination in which the gooseneck portion 116*a* is formed by providing a gooseneck core or passage within a valve body fastener 110*a*. The conduit 106 in this case would be coupled to the entry end of this passage, and the exit 118*a* from the passage would be located over the drain 122.

Because of the limited space within sleeve 40, the potable water conduit 84 is preferably made of copper formed into a semi-cylindrical shape. This leaves a semi-cylindrical space within which the plastic conduits 106 and 126 can be fitted. Of course, all of the conduits can be made of plastic material, if desired. All that is important is that the dimensions and shape of the conduits be made such that they are able to nest within the sleeve 40 in slidable relation. This enables the valve body 30 to be pulled upwardly of the housing 22 for inspection and servicing. In order to permit this upward raising of the valve body 30, each of the conduits 84, 106 and 126 extends below the lower end of the sleeve 40 enough to define a valve extension portion somewhat longer than the height of the housing 22. These extension portions are slidable within the sleeve 40 to permit the desired separation between the housing 22 and the valve body 30.

Figure 17:
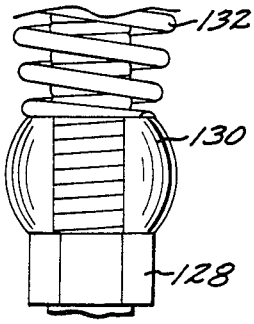
FIG. 17 is a detailed view of a spring and weight system associated with the lower extremity of the potable water conduit.

As seen in FIGS. 1, 2 and 17, a collar or stop 128 can be attached to the valve extension portions of the conduits 84, 106 and 126 to limit the amount of upward extension of the valve body 30.

Figure 18:
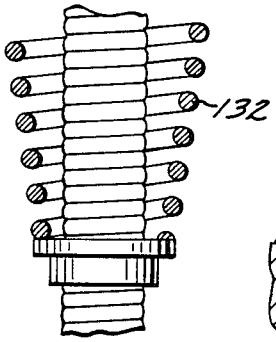
FIG. 18 is a view similar to FIG. 17, illustrating another form of bias means for limiting upper travel of the valve body.

If the potable water conduit is not made of some relatively rigid material such as copper alloy that can be forcibly pushed downwardly to rehouse the valve body 30 within the housing 22, a weight or bias means can be provided. In FIG. 17 both a weight means or weight 130 and a bias means as spring 132 are provided. FIG. 18 illustrates the use of a spring 132 without a weight. The spring 132 also provides a resilient stop or limit to the upward movement capability of the valve body.

Generally, it is helpful to know when the filters of the reverse osmosis system (not shown) need service. For this purpose, as best seen in FIG. 12, the upper gasket or bezel 27 can be provided with appropriate indicia 134 alignable with indicia 136 on the locking slide 92 to indicate when the filters were last serviced, etc.

The present fixture 10 easily accepts indicating means for operation in conjunction with recently developed systems for sampling the quality of the RO water. Such systems, known to those skilled in the art as "TDS" systems for measuring total dissolved solids, include sensitive probes responsive to the alkalinity or other indicator of the quality or purity of the RO water to provide an output signal indicating that the RO filters or membrane module need to be replaced. Such a signal is typically used to operate a light or other indicator.

As best seen in FIGS. 4, 10 and 13, there is adequate space between the valve body 30 and the housing 22 to receive a low voltage display lamp 208*a* mounted upon a bracket 209*a* which is secured in any suitable fashion to the body 30. electrical wires 206*a* extend from the lamp 208*a* through the sleeve 40 to the exteriorly located water quality sensing system (not shown). The illuminated lamp 208*a* is easily seen through a translucent plastic button 207*a* which is press fitted within a suitable opening in the cover 90.

From the foregoing it will be apparent that in all versions of the fixture 10, the existence of the freely slidable valve extension portions for the conduits 84, 106 and 126 permits easy elevation of the valve body 30 to the servicing position of FIG. 2 from the operating position of FIG. 1. Thus, the fixture is uniquely adapted for easy installation and maintenance. It provides an extremely reliable and easily checked airgap structure because the airgap system can be operated in the elevated or service position, it can easily be inspected and adjusted, unlike any fixture of the prior art. In addition, its various features render it suitable for "universal" application to various sink structures.

Various modifications and changes may be made with regard to the foregoing detailed description without departing from the spirit of the invention.

I claim:

1. A faucet fixture for attachment to sink structure having an upper surface and a lower surface spaced apart a predetermined thickness, said faucet fixture comprising:

an upper mounting plate having a central bore and adapted to overlie a faucet opening in said sink structure in engagement with said upper surface of said sink structure;

open-ended cylindrical housing means of predetermined height having a lower end located adjacent said upper mounting plate;

an elongated threaded sleeve having an upper end and a lower end, said sleeve being threadably disposed within said central bore, said sleeve being sufficiently long that said upper end opens into the interior of said housing means, and said lower end is adapted to extend below said lower surface of said sink structure;

a valve body received within the interior of said housing means and mounting a dispensing spout, said valve body being engaged upon the upper end of said housing means;

plate fastening means operative to removably secure said upper mounting plate to said sink structure;

a potable water conduit attached to said valve body and disposed through said sleeve, said water conduit having a portion extending below the lower end of said sleeve and constituting a valve extension portion approximating the length of said housing and freely slidable within said sleeve;

an inlet waste water conduit extending upwardly through said sleeve and terminating at its upper extremity in a reversely directed gooseneck portion having a downwardly directed discharge end;

mounting means securing said inlet waste water conduit to said valve body;

a cup shape drain receiver carried by said valve body a predetermined air gap distance below said gooseneck portion discharge end to receive water therefrom;

an outlet waste water conduit extending upwardly through said sleeve and attached at its upper end to said receiver for carrying away water in said receiver, said inlet waste water conduit and said outlet waste water conduit each having valve extension portions corresponding in length to said valve extension portion of said potable water conduit, all said conduits being dimensioned and grouped together so as to be freely upwardly and unitarily slidable in said sleeve to permit said valve body to be pulled upwardly of said housing means the length of said valve extension portion to expose said gooseneok portion and said drain receiver for inspection and maintenance thereof.

2. A faucet fixture according to claim 1 wherein said upper plates include a fastener bore, and including valve body fastener means carried by said valve body and received in said fastener bore for removably connecting said valve body to said upper mounting plate and drawing said valve body toward said mounting plate.

3. A faucet fixture according to claim 1 wherein said plate fastening means includes a threaded element engaged upon the lower extremity of said sleeve and adapted for engagement with said lower surface of said sink structure.

4. A faucet fixture according to claim 1 wherein said inlet waste water conduit is made of plastic, resiliently compressible material, and said mounting means are operative to adjustably compress said inlet waste water conduit to adjust the rate of flow of water therethrough.

5. A faucet fixture according to claim 1 wherein said potable water conduit is made of copper alloy material to slidably and closely engage the inner wall of said sleeve and define an adjacent space; and wherein said inlet and outlet waste water conduits are made of resilient plastic material and are axially slidably disposed through said adjacent space.

6. A faucet fixture according to claim 1 wherein said plate fastening means includes a lower mounting plate adapted for engagement with said lower surface of said sink structure and including a central opening for threadably receiving said sleeve, wherein said plate fastening ;means further includes a headed extremity on said sleeve, and said upper mounting plate includes a counterbore rotatably receiving said headed extremity.

7. A faucet fixture according to claim 1 wherein said valve body includes a depending boss and a valve actuating handle, and said upper mounting plate includes a series of apertures within which said boss in selectively receivable for selective orientation of said valve actuating handle.

8. A faucet fixture according to claim 1 and including an upper trim ring frictionally engaged upon said valve body whereby said upper trim ring may be pulled upwardly to extend said valve body above said housing means.

9. A faucet fixture according to claim 1 wherein the perimeter of said drain receiver is coextensive with the interior wall of said housing means.

10. A faucet fixture according to claim 1 wherein said housing means, said sleeve and said upper mounting plate are of circular cross section and are arranged in coaxial relationship.

11. A faucet fixture for attachment to sink structure having an upper surface and a lower surface spaced apart a predetermined thickness, said faucet fixture comprising:

an upper mounting plate having a central bore and adapted to overlie a faucet opening in said sink structure in engagement with said upper surface of said sink structure;

open-ended cylindrical housing means of predetermined height having a lower end located adjacent said upper mounting plate;

an elongated threaded sleeve having an upper end and a lower end, said sleeve being threadably disposed within said central bore, said sleeve being sufficiently long that said upper end opens into the interior of said housing means, and said lower end is adapted to extend below said lower surface of said sink structure;

a dispensing spout having an open lower extemity for receiving potable water;

a valve body received within the interior of said housing means and including a spout bore having an enlarged diameter upper spout bore extremity and a reduced diameter lower spout bore extremity, said spout being upwardly and downwardly adjustably movable in said spout bore in close fitting relation to said lower spout bore extremity, said valve body being engaged upon the upper end of said housing means;

seal means carried by said spout and engaging said upper spout bore extemity for providing a seal between said spout and said upper spout bore extremity;

plate fastening means operative to removably secure said upper mounting plate to said sink structure;

a potable water conduit attached to said valve body and disposed through said sleeve, said water conduit having a portion extending below the lower end of said sleeve and constituting a valve extension portion freely slidable within said sleeve; and a faucet lever support having a locking slide overlying said spout bore and engageable with said seal means to limit the extent of upward movement of said spout.

12. A faucet fixture according to claim 15 wherein said locking slide is slidable laterally of said spout bore out of overlying relation to said seal means to permit upward removal of said spout.

* * * * *

UNITED STATES PATENT AND TRADEMARK OFFICE

CERTIFICATE OF CORRECTION

PATENT NO. : 4,771,485

DATED : September 20, 1988

INVENTOR(S) : Paul L. Traylor

It is certified that error appears in the above-identified patent and that said Letters Patent is hereby corrected as shown below:

Column 1, line 31, delete "gaps" and insert --gap--;

Column 8, line 6, delete "as" and insert --or--;

Column 9, line 38, delete "gooseneok" and insert --gooseneck--; and

Column 10, line 64, delete "15" and insert --11--.

Signed and Sealed this

Thirty-first Day of January, 1989

*Attest:*

*Attesting Officer*

DONALD J. QUIGG

*Commissioner of Patents and Trademarks*